US009112309B1

(12) United States Patent
Chen et al.

(10) Patent No.: US 9,112,309 B1
(45) Date of Patent: Aug. 18, 2015

(54) NETWORK CONNECTOR SOCKET

(71) Applicant: YFC-BONEAGLE Electric Co., Ltd., Taoyuan County (TW)

(72) Inventors: Chun-Chieh Chen, Taoyuan County (TW); Ying-Ming Ku, Taoyuan County (TW)

(73) Assignee: YFC-BONEAGLE ELECTRIC CO., LTD., Taoyuan County (TW)

( * ) Notice: Subject to any disclaimer, the term of this patent is extended or adjusted under 35 U.S.C. 154(b) by 66 days.

(21) Appl. No.: 14/167,508

(22) Filed: Jan. 29, 2014

(51) Int. Cl.
*H01R 24/00* (2011.01)
*H01R 13/6467* (2011.01)
*H01R 24/64* (2011.01)
*H01R 107/00* (2006.01)

(52) U.S. Cl.
CPC ..... *H01R 13/6467* (2013.01); *H01R 24/64* (2013.01); *H01R 2107/00* (2013.01)

(58) Field of Classification Search
CPC ..... H01R 23/025
USPC ..... 439/676, 941
See application file for complete search history.

(56) References Cited

U.S. PATENT DOCUMENTS 6,065,994 A * 5/2000 Hashim et al. ..... 439/404
6,932,655 B2 * 8/2005 Hatterscheid et al. ..... 439/676
7,134,917 B2 * 11/2006 Deng et al. ..... 439/676
7,658,648 B2 * 2/2010 Aekins ..... 439/620.11

* cited by examiner

*Primary Examiner* — Phuong Dinh
(74) *Attorney, Agent, or Firm* — Chun-Ming Shih; HDLS IPR Services

(57) ABSTRACT

A network connector socket includes an insulated body, first contacts, and second contacts. Each first contact includes a first fixed segment fixed in the insulated body. The first fixed segments are arranged in parallel on a first plane. Each second contact includes a second fixed segment fixed in the insulated body. The second fixed segments extend on a second plane spaced apart with the first plane and are arranged in parallel. One of the first fixed segments is bent and extends to cross at least one of the second fixed segments. For one of the first contacts, the corresponding first fixed segment has a larger transverse width than that of the rest. For one of the second contacts, the corresponding second fixed segment has a larger transverse width than that of the rest. Thus, the crosstalk noise between the contacts is reduced by capacitive compensation.

10 Claims, 6 Drawing Sheets

NETWORK CONNECTOR SOCKET

BACKGROUND OF THE INVENTION

1. Field of the Invention

The present invention relates to a network connector socket and, in particular, to a network connector socket having a structure reducing the crosstalk noise.

2. Description of Related Art

A currently popular network connector, an RJ45 connector, has eight contacts defined in its specification. The eight contacts are needle-shaped contacts arranged in parallel, which results in crosstalk noise between two adjacent contacts due to magnetic field interferences when signal transmission. As a result, the quality of the signal transmission is seriously affected.

In view of this, the inventor pays special attention to research with the application of related theory and tries to overcome the above disadvantages regarding the above related art, which becomes the goal of the inventor's improvement.

SUMMARY OF THE INVENTION

The present invention is to provide a network connector socket have a feature of low crosstalk.

The present invention provides a network connector socket comprising an insulated body, a plurality of first contacts, and a plurality of second contacts. Each of the first contacts comprises a first fixed segment fixed in the insulated body. The first fixed segments are arranged in parallel on a first plane and coplanar with each other. Each of the second contacts comprises a second fixed segment fixed in the insulated body. The second fixed segments extend on a second plane spaced apart with the first plane and are arranged in parallel. One of the first fixed segments is bent and extends to cross at least one of the second fixed segments. For one of the first contacts, the corresponding first fixed segment has a larger transverse width than that of the rest; for one of the second contact, the corresponding second fixed segment has a larger transverse width than that of the rest.

Preferably, in the above-mentioned network connector socket, one end of each of the first fixed segments extends to form a first clamping segment and one end of each of the second fixed segments extends to form a second clamping segment . The first clamping segments and the second clamping segment are arranged alternately in parallel and coplanar with each other.

Preferably, in the above-mentioned network connector socket, the other end of each of the first fixed segments extends to form a first welding segment and the other end of each of the second fixed segments extends to form a second welding segment. The first welding segments are arranged in parallel along a first row and the second welding segments are arranged in parallel along a second rows, in which the first and second rows are in parallel to each other.

Preferably, in the above-mentioned network connector socket, for each of the first contacts, the corresponding junction of the first fixed segment and the first welding segment is bent; for each of the second contacts, the corresponding junction of the second fixed segment and the second welding segment is bent.

Preferably, the above-mentioned network connector socket further comprises a housing in which the insulated body is received.

Preferably, the above-mentioned network connector socket further comprises a housing in which the insulated body is received. The housing has a receiving port to which the first clamping segments and the second clamping segments are disposed correspondingly.

Preferably, the above-mentioned network connector socket further comprises a housing in which the insulated body is received. The first clamping segments and the second welding segments protrude out of the housing.

Preferably, in the above-mentioned network connector socket, a positioning pin protrudes from the housing and extends in the same direction as those of the first welding segments and the second welding segments.

Preferably, in the above-mentioned network connector socket, one of the first contacts and one of the second contacts cross mutually and are both disposed at one side of the first fixed segment having a larger transverse width; the other one of the first contacts and the other one of the second contacts cross mutually and are both disposed at the other side of the first fixed segment having a larger transverse width.

Preferably, in the above-mentioned network connector socket, one of the first contacts and one of the second contacts cross mutually and are disposed at one side of the second fixed segment having a larger transverse width; the other one of the first contacts and the other one of the second contacts cross mutually and are disposed at the other side of the second fixed segment having a larger transverse width.

The present invention uses a cross configuration of the first contacts and the second contacts to produce a capacitive compensation effect in between. Also, another capacitive compensation effect is produced by means of the transverse width change of the first contact (or the second contact) in conjunction of its adjacent first contact (or the second contact). Therefore, the crosstalk noise between the contacts can be reduced by the capacitive compensation effects.

DETAILED DESCRIPTION OF THE INVENTION

Figure 1:
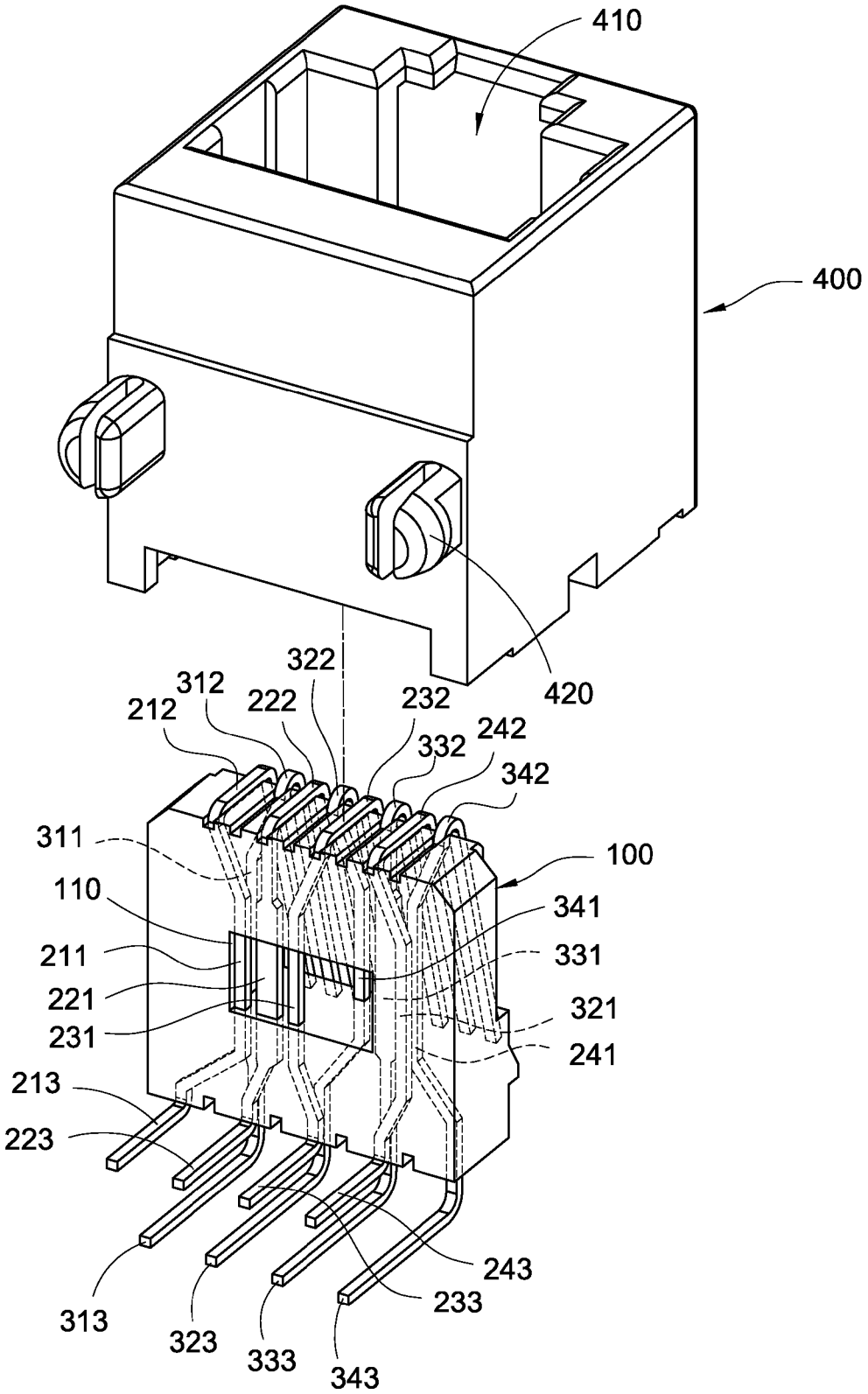
FIG. 1 is a perspective schematic view of a network connector socket according to a preferred embodiment of the present invention.
Figure 2:
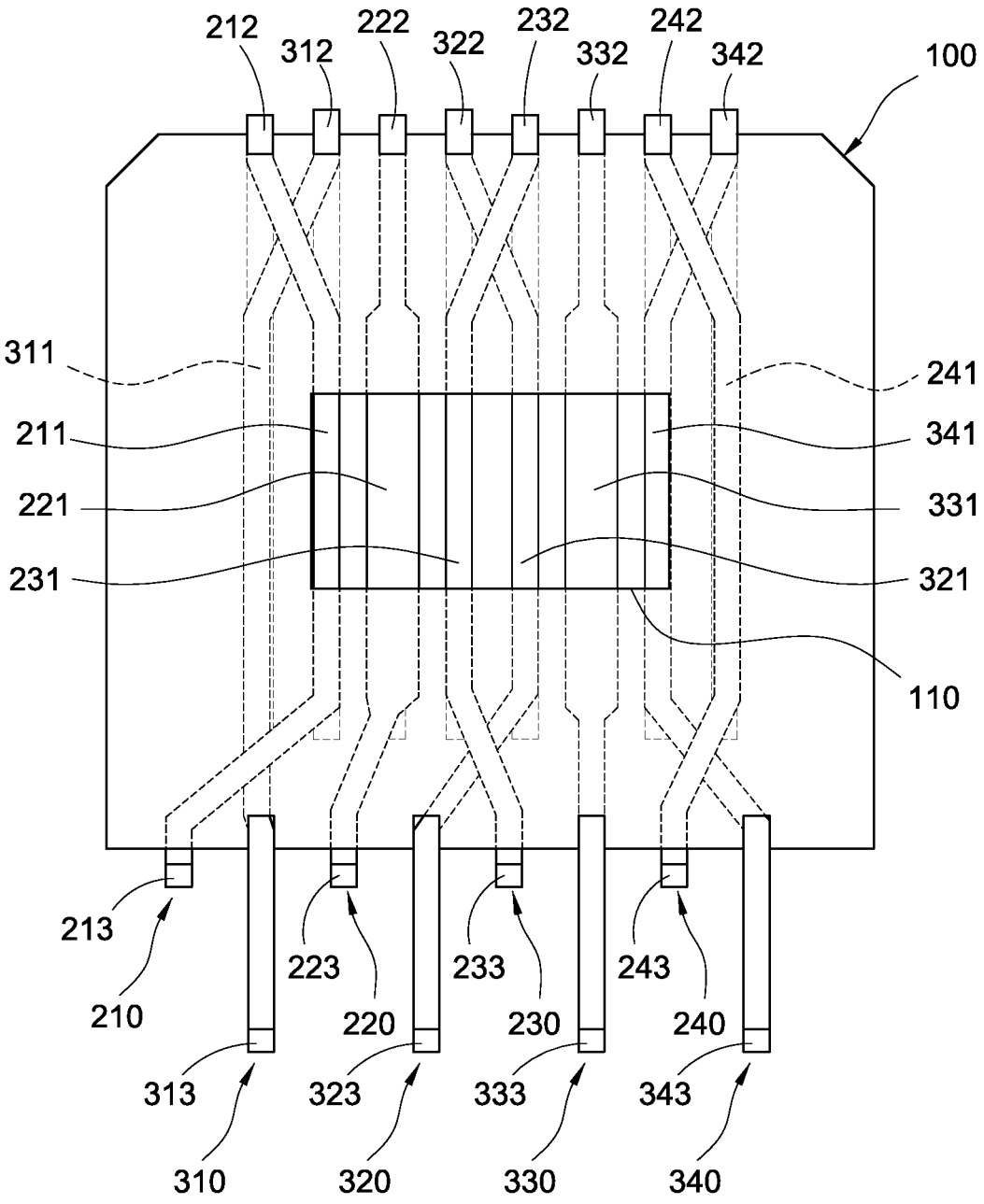
FIG. 2 is a bottom view of a network connector socket according to the preferred embodiment of the present invention.
Figure 3:
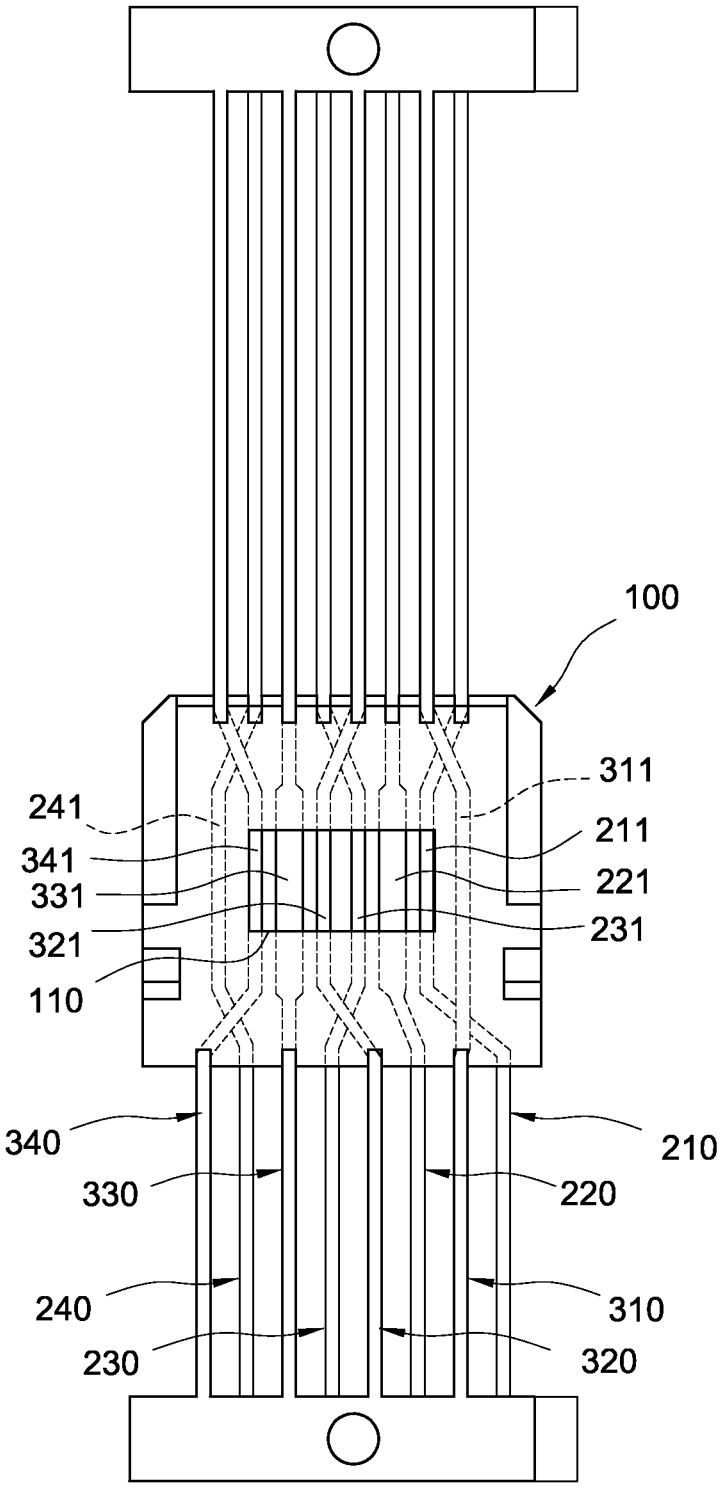
FIG. 3 is a top view of a network connector socket according to the preferred embodiment of the present invention.
Figure 4:
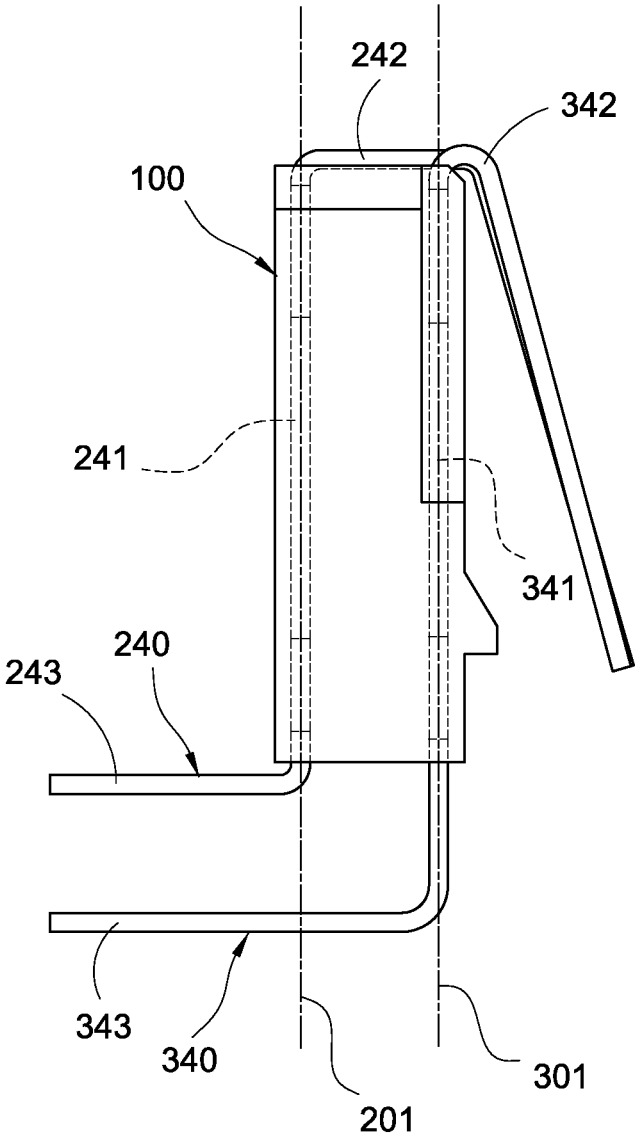
FIG. 4 is a side view of a network connector socket according to the preferred embodiment of the present invention.
Figure 5:
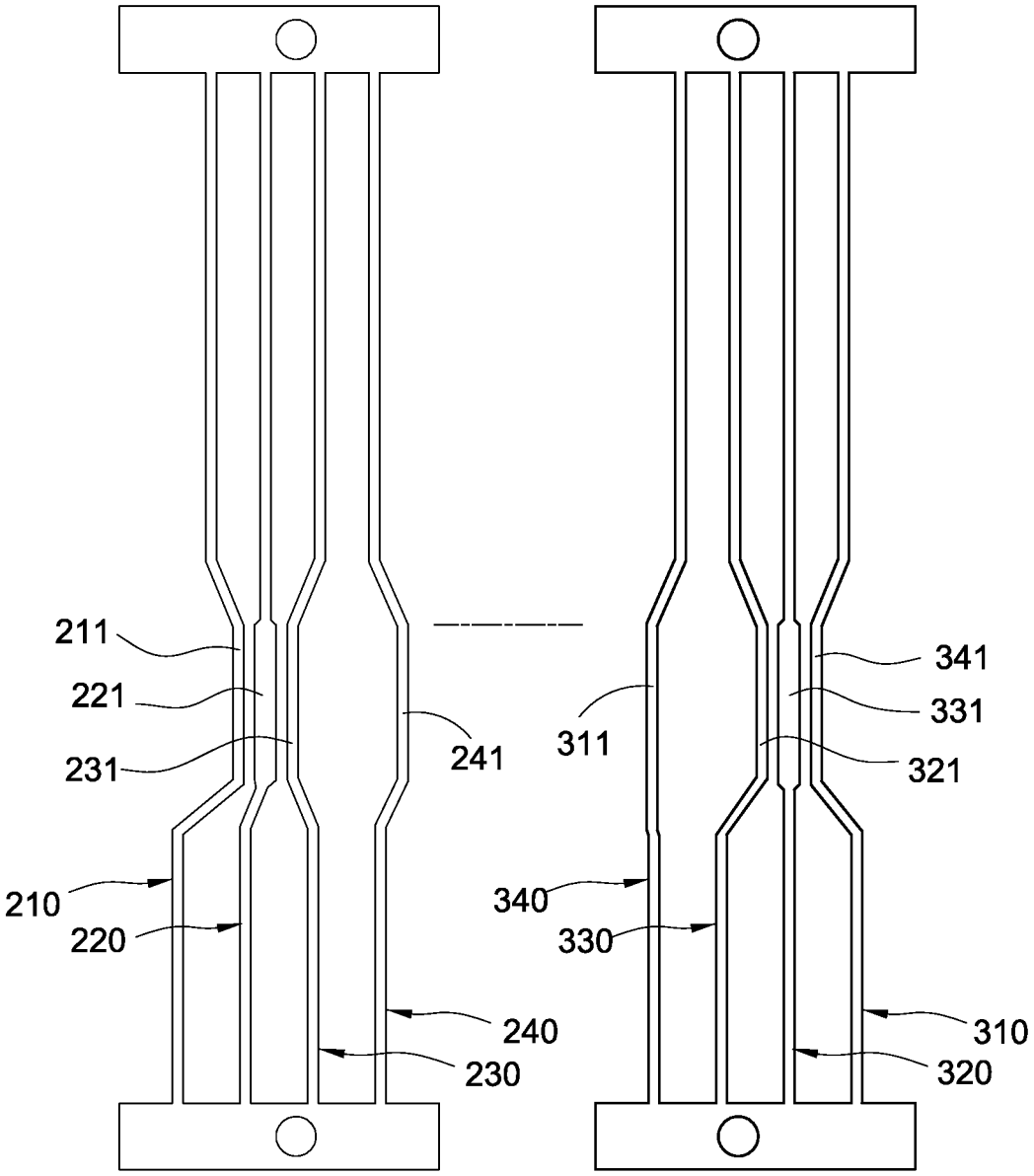
FIG. 5 is a schematic view showing the first contacts and second contacts according to the preferred embodiment of the present invention.
Figure 6:
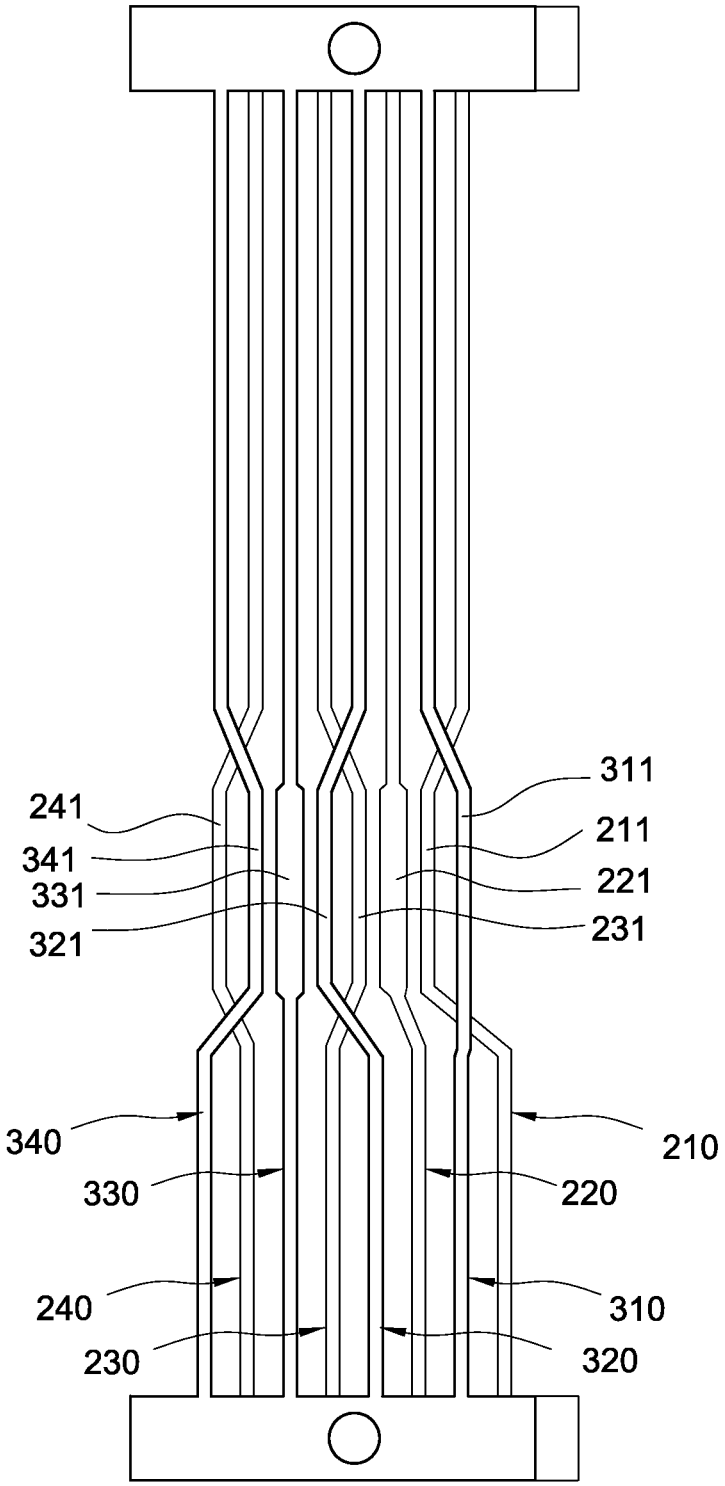
FIG. 6 is a schematic view showing the relative position between the first contacts and second contacts according to the preferred embodiment of the present invention.

Please refer to FIGS. 1-3, which show a network connector socket according to a preferred embodiment of the present invention. The network connector socket comprises an insulated body 100, a plurality of first contacts 210/220/230/240, a plurality of second contacts 310/320/330/340, and a housing 400.

In the current embodiment, the insulated body 100 is preferably a bulk made of plastic. Two recesses 110/120 are formed on the insulated body 100, opposite to each other. In particular, the two recesses 110/120 penetrate through the insulated body 100 and communicate with each other, but the present invention is not limited to this. The insulated body 100 is used to secure the relative positions between the first contacts 210/220/230/240 and the second contacts 310/320/330/340.

Please refer to FIGS. 1, 2, 4, 5, and 6. The first contacts 210/220/230/240 are bent metal strips. In the current embodiment, the network connector socket comprises four first contacts 210/220/230/240 spaced roughly in parallel with each other. Each of the first contacts 210/220/230/240 comprises a first fixed segment 211 or 221 or 231 or 241, a first clamping segment 212 or 222 or 232 or 242, and a first welding segment 213 or 223 or 233 or 243, in which the last two extend from two ends of each first fixed segment 211 or 221 or 231 or 241, respectively. The first fixed segments 211/221/231/241 are fixed in the insulated body 100 by means of the insert molding of the insulated body 100. The first fixed segments 211/221/231/241 are arranged in parallel on a first plane 201 and coplanar with each other, whereby to fix the first contacts 210/220/230/240. The first fixed segments 211/221/231 of some first contacts 210/220/230 are exposed to a recess 110 of the insulated body 100. In the current embodiment, two ends of each of the first fixed segments 211/221/231 of the three first contacts 210/220/230 bend and extend on the first plane 201; one end of the first fixed segments 221 of the first contact 220 bends and extends on the first plane 201. For the first contact 220, the first fixed segment 221 has a larger transverse width than that of the rest. The first clamping segments 212/222/232/242 are configured in such a manner that they extend from the corresponding first fixed segments 211/221/231/241 and bend by 90 degrees. The first welding segments 213/223/233/243 are for being welded to a PCB such that the network connector socket of the present invention is electrically connected to the PCB. In the current embodiment, the first welding segments 213/223/233/243 of the first contacts 210/220/230/240 are configured in such a manner that they extend from the corresponding first fixed segments 211/221/231/241 and bend by 90 degrees; however, the present invention is not limited to this. The configuration of the first welding segments 213/223/233/243 can be changed according to the configuration of the network connector socket disposed on the PCB. For example, the first welding segments 213/223/233/243 and the first fixed segments 211/221/231/241 can also be disposed on the same plane.

Please refer to FIGS. 1, 3, 4, 5, and 6. The second contacts 310/320/330/340 are bent metal strips. Each of the second contacts 310/320/330/340 comprises a second fixed segment 311 or 321 or 331 or 341, a second clamping segment 312 or 322 or 332 or 342, and a second welding segment 313 or 323 or 333 or 343, in which the last two extend from two ends of each second fixed segment 311 or 321 or 331 or 341, respectively. The second fixed segments 311/321/331/341 are fixed in the insulated body 100 by means of the insert molding of the insulated body 100. The second fixed segments 311/321/331/341 are arranged in parallel on a second plane 301 and coplanar with each other, whereby to fix the second contacts 310/320/330/340. The second fixed segments 321/331/341 of some second contacts 320/330/340 are exposed to a recess 120 of the insulated body 100. In the current embodiment, two ends of each of the second fixed segments 311/321/341 of the three second contacts 310/320/340 bend and extend on the second plane 301; one end of the second fixed segments 331 of the second contact 330 extends straight on the second plane 301. For the second contact 330, the second fixed segment 331 has a larger transverse width than that of the rest. The second clamping segments 312/322/332/342 are configured in such a manner that they extend from the corresponding second fixed segments 311/321/331/341 and bend by 90 degrees. The second welding segments 313/323/333/343 are for being welded to the above-mentioned PCB such that the network connector socket of the present invention is electrically connected to the PCB. In the current embodiment, the second welding segments 313/323/333/343 of the second contacts 310/320/330/340 are configured in such a manner that they extend from the corresponding second fixed segments 311/321/331/341 and bend by 90 degrees; however, the present invention is not limited to this. The configuration of the second welding segments 313/323/333/343 can be changed according to the configuration of the network connector socket disposed on the PCB. For example, the second welding segments 313/323/333/343 and the second fixed segments 311/321/331/341 can also be disposed on the same plane.

In the current embodiment, three bent extended first fixed segments 211/231/241 are disposed corresponding to three bent extended second fixed segments 311/321/341, respectively. Two corresponding segments 211/311 or 231/321 or 241/341 bend in opposite directions such that two crosses are formed between the two corresponding segments. The first fixed segments 211 and the second fixed segment 311 cross mutually and are both disposed at one side of the first fixed segment 221 having a larger transverse width; the first fixed segment 231 and the second fixed segment 321 cross mutually and are disposed at the other side of the first fixed segment 221 having the larger transverse width. The first fixed segments 231 and the second fixed segments 321 cross mutually and are both disposed at one side of the second fixed segment 331 having a larger transverse width; the first fixed segments 241 and the second fixed segment 341 cross mutually and are both disposed at the other side of the second fixed segment 331 having the larger transverse width.

Please refer to FIG. 1. In the current embodiment, the housing 400 is preferably a hollow rectangular parallelepiped made of plastic. One side of the housing 400 has a receiving port 410 into which the network connector socket can be plugged. A positioning pin 420 protrudes from another side of the housing 400. In the current embodiment, there are two positioning pins 420; however, the number of the positioning pins is not limited. The positioning pins 420 are used to latch a PCB such that the network connector socket of the present invention can be fixed to the PCB. The insulated body 100 is received in the housing 400. The first clamping segments 212/222/232/242 and the second clamping segments 312/322/332/342 are disposed corresponding to the receiving port 410. When the network connector socket is plugged into the receiving port 410, The first clamping segments 212/222/232/242 and the second clamping segments 312/322/332/342 can contact and electrically connect to the network connector socket, thus enabling the network connector socket to electrically connect to the PCB.

The first welding segments 213/223/233/243 and the second welding segments 313/323/333/343 protrude out of the housing 400. The first welding segments 213/223/233/243 and the second welding segments 313/323/333/343 are arranged alternately in parallel and coplanar with each other. The first clamping segments 212/222/232/242 are arranged in parallel along a first row and the second clamping segments 312/322/332/342 are arranged in parallel along a second rows, in which the first and second rows are in parallel to each other. The positioning pins 420 extend in the same direction as those of the first welding segments 213/223/233/243 and the second welding segments 313/323/33/343.

The present invention uses a cross configuration of the first contacts 210/230/240 and the second contacts 310/320/340 to produce a capacitive compensation effect in between; thus, the crosstalk noise between the first contacts 210/230/240 and the second contacts 310/320/340 can be reduced. In addition, the transverse width change of the first contact 220 (or the second contact 330) in conjunction of its adjacent first contact 210 or 230 (or the second contact 320 or 340) produces another capacitive compensation effect, which reduces the crosstalk noise between two adjacent first contacts (or second contacts). Further, the first contacts 210/220/230 (or second contacts 320/330/340) are exposed to the recess 110 (or 120) of the insulated body 100, which can change the medium, i.e., plastic is changed to air, between two adjacent parts of the first contacts (or the second contacts); thus the crosstalk noise between the two adjacent parts of the first contacts (or the second contacts) can be reduced by the capacitive compensation effect generated in between.

The embodiments described above are only preferred ones of the present invention and not to limit the scope of appending claims regarding the present invention. Therefore, all the equivalent modifications applying the spirit of the present invention should be embraced by the scope of the present invention.

What is claimed is:

1. A network connector socket, comprising:

an insulated body (100);

a plurality of first contacts (210, 220, 230, 240), each of the first contacts (210, 220, 230, 240) comprising a first fixed segment (211, 221, 231, 241) fixed in the insulated body (100), wherein the first fixed segments (211, 221, 231, 241) are arranged in parallel on a first plane (201) and coplanar with each other; and a plurality of second contacts (310, 320, 330, 340), each of the second contacts (310, 320, 330, 340) comprising a second fixed segment (311, 321, 331, 341) fixed in the insulated body (100), wherein the second fixed segments (311, 321, 331, 341) extend on a second plane (301) spaced apart with the first plane (201) and are arranged in parallel, wherein one of the first fixed segments (211, 221, 231, 241) is bent and extends to cross at least one of the second fixed segments (311, 321, 331, 341), wherein for one of the first contacts (210, 220, 230, 240), the corresponding first fixed segment (211, 221, 231, 241) has a larger transverse width than that of the rest, wherein for one of the second contacts (310, 320, 330, 340), the corresponding second fixed segment (311, 321, 331, 341) has a larger transverse width than that of the rest.

2. The network connector socket according to claim 1, wherein one end of each of the first fixed segments (211, 221, 231, 241) extends to form a first clamping segment (212, 222, 232, 242) and one end of each of the second fixed segments (311, 321, 331, 341) extends to form a second clamping segment (312, 322, 332, 342), wherein the first clamping segments (212, 222, 232, 242) and the second clamping segment (312, 322, 332, 342) are arranged alternately in parallel and coplanar with each other, wherein the other end of each of the first fixed segments (211, 221, 231, 241) extends to form a first welding segment (213, 223, 233, 243) and the other end of each of the second fixed segments (311, 321, 331, 341) extends to form a second welding segment (313, 323, 333, 343), wherein the first welding segments (213, 223, 233, 243) are arranged in parallel along a first row and the second welding segments (313, 323, 333, 343) are arranged in parallel along a second rows, wherein the first and second rows are in parallel to each other.

3. The network connector socket according to claim 2, wherein for each of the first contacts (210, 220, 230, 240), the corresponding junction of the first fixed segment (211, 221, 231, 241) and the first welding segment (213, 223, 233, 243) are bent, wherein for each of the second contacts (310, 320, 330, 340), the corresponding junction of the second fixed segment (311, 321, 331, 341) and the second welding segment (313, 323, 333, 343) are bent.

4. The network connector socket according to claim 1, further comprising a housing (400) in which the insulated body (100) is received.

5. The network connector socket according to claim 2, further comprising a housing (400) in which the insulated body (100) is received, wherein the housing (400) has a receiving port (410), wherein the first clamping segments (212, 222, 232, 242) and the second clamping segments (312, 322, 332, 342) are disposed corresponding to the receiving port (410).

6. The network connector socket according to claim 2, further comprising a housing (400) in which the insulated body (100) is received, wherein the first welding segments (213, 223, 233, 243) and the second welding segments (313, 323, 333, 343) protrude out of the housing (400).

7. The network connector socket according to claim 3, further comprising a housing (400) in which the insulated body (100) is received, wherein the first clamping segments (212, 222, 232, 242) and the second welding segments (313, 323, 333, 343) protrude out of the housing (400).

8. The network connector socket according to claim 7, wherein a positioning pin (420) protrudes from the housing (400) and extends in the same direction as those of the first welding segments (213, 223, 233, 243) and the second welding segments (313, 323, 333, 343).

9. The network connector socket according to claim 1, wherein one of the first fixed segments (211, 231) and one of the second fixed segments (321, 321) cross mutually and are both disposed at one side of the first fixed segment (221) having a larger transverse width, wherein the other one of the first fixed segments (211, 231) and the other one of the second fixed segments (321, 331) cross mutually and are both disposed at the other side of the first fixed segment (221) having the larger transverse width.

10. The network connector socket according to claim 1, wherein one of the first fixed segments (231, 241) and one of the second fixed segments (331, 341) cross mutually and are disposed at one side of the second fixed segment (331) having a larger transverse width, the other one of the first fixed segments (231, 241) and the other one of the second fixed segments (331, 341) cross mutually and are disposed at the other side of the second fixed segment (331) having the larger transverse width.

* * * * *